US008701424B2

(12) United States Patent
Ueda et al.

(10) Patent No.: US 8,701,424 B2
(45) Date of Patent: Apr. 22, 2014

(54) TURBO CHILLER, HEAT SOURCE SYSTEM, AND METHOD FOR CONTROLLING THE SAME

(75) Inventors: Kenji Ueda, Aichi (JP); Minoru Matsuo, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 855 days.

(21) Appl. No.: 12/443,540

(22) PCT Filed: Nov. 26, 2008

(86) PCT No.: PCT/JP2008/071402

§ 371 (c)(1),
(2), (4) Date: Mar. 30, 2009

(87) PCT Pub. No.: WO2009/107296

PCT Pub. Date: Sep. 3, 2009

(65) Prior Publication Data

US 2010/0180629 A1 Jul. 22, 2010

(30) Foreign Application Priority Data

Feb. 27, 2008 (JP) ..... 2008-046911

(51) Int. Cl.
*F28D 17/02* (2006.01)

(52) U.S. Cl.
USPC ..... 62/98; 62/185

(58) Field of Classification Search
USPC ..... 62/98, 185, 201, 180, 228.3
See application file for complete search history.

(56) References Cited

U.S. PATENT DOCUMENTS

| | | | | | |
|---|---|---|---|---|---|
| 2,495,625 | A | * | 1/1950 | Bodinus | 62/99 |
| 2,512,545 | A | * | 6/1950 | Hazard | 62/98 |
| 3,257,818 | A | * | 6/1966 | Papapanu | 62/98 |
| 4,124,177 | A | * | 11/1978 | Timmerman | 237/2 B |
| 4,502,289 | A | * | 3/1985 | Kayama | 62/185 |
| 4,787,211 | A | * | 11/1988 | Shaw | 62/117 |

(Continued)

FOREIGN PATENT DOCUMENTS

| | | | |
|---|---|---|---|
| JP | 07-027432 | * | 1/1995 |
| JP | 7-27432 | A | 1/1995 |

(Continued)

OTHER PUBLICATIONS

International Search Report of PCT/JP2008/071402, date of mailing date Jan. 13, 2009.

(Continued)

*Primary Examiner* — Ljiljana Ciric
*Assistant Examiner* — Alexis Cox
(74) *Attorney, Agent, or Firm* — Westerman, Hattori, Daniels & Adrian, LLP

(57) ABSTRACT

A turbo chiller that allows for temperature adjustment even when a target heat load is low is provided. A turbo chiller (11) is equipped with a chiller-side control unit that controls an operation so that a coolant outlet temperature is equal to a desired value. When a target heat load is lower than or equal to a predetermined value, the chiller-side control unit outputs a target coolant flow rate, which satisfies the target heat load, of the coolant on the basis of a current coolant inlet temperature, which is a current temperature of the coolant flowing into an evaporator, and a target coolant outlet temperature, which is a coolant outlet temperature to be targeted.

5 Claims, 4 Drawing Sheets

(56) References Cited

U.S. PATENT DOCUMENTS

| | | | | |
|---|---|---|---|---|
| 5,884,498 | A * | 3/1999 | Kishimoto et al. | 62/228.1 |
| 6,134,911 | A * | 10/2000 | Kishimoto et al. | 62/505 |
| 8,132,421 | B2 * | 3/2012 | Ueda | 62/209 |
| 8,220,284 | B2 * | 7/2012 | Tsubone | 62/324.4 |
| 2004/0000155 | A1 * | 1/2004 | Cline et al. | 62/175 |
| 2006/0010893 | A1 * | 1/2006 | Dominguez | 62/201 |
| 2007/0074863 | A1 * | 4/2007 | Ichinose et al. | 165/247 |
| 2009/0301113 | A1 * | 12/2009 | Ueda et al. | 62/115 |

FOREIGN PATENT DOCUMENTS

| | | | |
|---|---|---|---|
| JP | 07-035420 | A | 2/1995 |
| JP | 07-035426 | A | 2/1995 |
| JP | 2001-124387 | A | 5/2001 |
| JP | 2001124387 | A * | 5/2001 |
| JP | 2001-221482 | A | 8/2001 |
| JP | 2001221482 | A * | 8/2001 |
| JP | 2003-121024 | A | 4/2003 |
| JP | 2003121024 | A * | 4/2003 |
| JP | 2003-130428 | A | 5/2003 |
| JP | 2003130428 | A * | 5/2003 |
| JP | 2003-262384 | A | 9/2003 |
| JP | 2003-269779 | A | 9/2003 |
| JP | 2003262384 | A * | 9/2003 |
| JP | 2003269779 | A * | 9/2003 |
| JP | 2004-144411 | A | 5/2004 |
| JP | 2004144411 | A * | 5/2004 |
| JP | 2006-46839 | A | 2/2006 |
| JP | 2007-225213 | A | 9/2007 |
| JP | 2007225213 | A * | 9/2007 |
| JP | 2007-278523 | A | 10/2007 |
| JP | 2007278523 | A * | 10/2007 |
| JP | 2009-2635 | A | 1/2009 |

OTHER PUBLICATIONS

Japanese Office Action dated Jun. 4, 2013, issued in corresponding Japanese Patent Application No. 2008-046911, 9 pages (with English translation).

Japanese Decision to Grant a Patent dated Feb. 4, 2014, issued in corresponding Japanese Patent Application No. 2008-046911 with partial translation.

* cited by examiner

TURBO CHILLER, HEAT SOURCE SYSTEM, AND METHOD FOR CONTROLLING THE SAME

TECHNICAL FIELD

The present invention relates to turbo chillers, heat source systems, and methods for controlling the same.

BACKGROUND ART

There are heat source systems that have a plurality of parallel-connected turbo chillers and that produce a coolant by obtaining cold energy from these chillers. The coolant obtained by the heat source system is supplied to an external load, such as an air conditioner or a fan coil unit, installed in a plant facility or a building.

In such heat source systems, it is necessary to continue the operation thereof even when the heat load requested by the external load is low. As methods for continuing the operation even when the heat load is low, technologies discussed in Patent Documents 1 and 2 are known.

Patent Document 1:

Japanese Unexamined Patent Application, Publication No. Hei 7-35426

Patent Document 2:

Japanese Unexamined Patent Application, Publication No. Hei 7-35420

DISCLOSURE OF INVENTION

However, even if the operation can be continued at a low heat load, it is demanded that the operation be performed with low heat load while controlling the temperature to that required by the external load. For example, when a requested target heat load increases and the number of stages is to be increased by increasing the number of operated turbo chillers, it is preferable that, before starting the operation, a turbo chiller to be brought online be set on standby while maintaining a coolant temperature requested by the external load, namely, while driving the turbo chiller with low load so as to satisfy the requested coolant temperature. When the target heat load decreases and the number of stages is to be reduced by reducing the number operated turbo chillers, such operation is also required for a turbo chiller to be subsequently stopped.

In view of these circumstances, an object of the present invention is to provide a turbo chiller and a heat source system that allow for temperature adjustment even when a target heat load is low, and a method for controlling the same.

In order to achieve the aforementioned object, a turbo chiller, a heat source system, and a method for controlling the same employ the following solutions.

Specifically, in a first aspect of a turbo chiller according to the present invention in which the turbo chiller includes a turbo compressor that compresses a refrigerant, a condenser that condenses the compressed refrigerant, an expansion valve that expands the condensed refrigerant, an evaporator that evaporates the expanded refrigerant and cools a coolant, and a chiller-side control unit that controls an operation so that a coolant outlet temperature, which is the temperature of the coolant cooled at the evaporator, is equal to a desired value, the chiller-side control unit is given a target heat load at which the coolant is output, and when the target heat load is lower than or equal to a predetermined value, the chiller-side control unit outputs a target coolant flow rate, which satisfies the target heat load, of the coolant on the basis of a current coolant inlet temperature, which is a current temperature of the coolant flowing into the evaporator, and a target coolant outlet temperature, which is a coolant outlet temperature to be targeted.

A load (i.e., an output) from the turbo chiller is proportional to a temperature difference between a coolant inlet temperature and a coolant outlet temperature and to a coolant flow rate. Consequently, when the target heat load is lower than or equal to a predetermined value (for example, 20% or lower, and preferably, 10% or lower), there is a limit to reducing the heat load of the turbo chiller so long as the coolant flow rate is a rated flow rate. In the case of an operation in which no particular target coolant outlet temperature is set and a heat load is not to be output, the operation may be performed on the basis of an invention set forth in Japanese Patent Application No. 2007-166843 previously applied by the present inventors, et al. In contrast, problems occur when a target coolant outlet temperature is set and the given target heat load is low.

In the first aspect, the chiller-side control unit is configured to output a target coolant flow rate that satisfies a target heat load on the basis of a current coolant inlet temperature and a target coolant outlet temperature. The coolant is supplied to the turbo chiller on the basis of this target coolant flow rate, thereby achieving a temperature adjustment operation in which the temperature can be controlled to the target coolant outlet temperature even when the target heat load is low.

Furthermore, in the turbo chiller of the first aspect, the chiller-side control unit may obtain a current coolant flow rate, which is a coolant flow rate in a current state, and perform an operation for stopping the operation of the turbo chiller when the current coolant flow rate is lower than or equal to a predetermined value that falls below the target coolant flow rate.

Because the turbo chiller continues to output a refrigeration load even when the coolant flow rate is low, if the coolant stops flowing for any reason, the coolant may possibly freeze inside a heat transfer tube of the evaporator. Therefore, in the above aspect, the operation of the turbo chiller is made to stop when the current coolant flow rate is lower than or equal to a predetermined value that falls below the target coolant flow rate.

It is preferable that a threshold of the current coolant flow rate to be used when performing the stopping operation of the turbo chiller be changed according to the target coolant flow rate. For example, the stopping operation may be performed when the flow rate falls below a predetermined percentage, such as 60%, of the target coolant flow rate. Accordingly, the threshold can be set appropriately in accordance with the target coolant flow rate. However, for protection of the device, the stopping operation is always performed when the flow rate is extremely low, such as 2% of the rated flow rate.

Furthermore, in the turbo chiller of the first aspect, the chiller-side control unit may obtain an evaporation pressure inside the evaporator and perform an operation for stopping the operation of the turbo chiller when the evaporation pressure is lower than or equal to a predetermined value.

Because the turbo chiller continues to output a refrigeration load even when the coolant flow rate is low, if the coolant stops flowing for any reason, the coolant may possibly freeze inside the heat transfer tube of the evaporator. Therefore, in the above aspect, the evaporation pressure inside the evaporator is obtained so to ascertain the state of the coolant flowing through the heat transfer tube. Accordingly, if the evaporation pressure is lower than or equal to a predetermined value, it is determined that there is a possibility that the coolant may freeze, thus stopping the operation of the turbo chiller. This control based on the evaporation pressure may be used in combination with the aforementioned current coolant flow rate or may be used alone.

Furthermore, a liquid refrigerant temperature of the evaporator or a current coolant outlet temperature may be used as a backup.

Furthermore, in the turbo chiller of the first aspect, sensitivity to a feedback-control output to be given to a temperature adjusting unit that controls the temperature of the coolant may be reduced according to a decrease in a current coolant flow rate.

A control gain of feedback control (e.g., PID control or PI control) to be provided to the temperature adjusting unit is normally set based on when the coolant flow rate is equal to the rating. When the coolant flow rate is lower than the rating, the use of a control gain for the rating causes the sensitivity to be excessively high, thus possibly resulting in overshooting of the coolant temperature. Therefore, in the above aspect, the sensitivity of the feedback-control output is reduced according to a decrease in the current coolant flow rate so as to ensure controllability. In detail, for example, a proportional gain is set in inverse proportion to the coolant flow rate. Alternatively, an integral time of an integral gain may be set in inverse proportion to the coolant flow rate.

An example of a "temperature adjusting unit" is inlet vanes (i.e., an inlet guide vane for capacity control) provided at a refrigerant-gas intake port of the turbo compressor and configured to adjust the amount of refrigerant gas to be taken in.

In a second aspect of a heat source system according to the present invention in which the heat source system includes a plurality of turbo chillers, a coolant supplying unit that supplies a coolant supplied from these turbo chillers to an external load, and a facility-side control unit that controls a flow rate and the temperature of the coolant, at least one of the plurality of turbo chillers is one of the aforementioned turbo chillers, and the chiller-side control unit in the turbo chiller obtains the target coolant outlet temperature and the target heat load from the facility-side control unit and outputs the target coolant flow rate to the facility-side control unit.

In a typical heat source system, the coolant temperature and the coolant flow rate are controlled at the facility-side control unit that performs centralized control of the entire operation of the heat source system. In addition, the facility-side control unit can ascertain a target heat load that can be tolerated even when the load is low. In the second aspect, the target coolant outlet temperature and the target heat load are sent to the chiller-side control unit from the facility-side control unit. The facility-side control unit is capable of obtaining the target coolant flow rate output from the chiller-side control unit of the turbo chiller. Accordingly, a heat source system that allows for a temperature adjustment operation even when the target heat load is low can be provided.

In a third aspect of a method for controlling a turbo chiller of the present invention in which the turbo chiller includes a turbo compressor that compresses a refrigerant, a condenser that condenses the compressed refrigerant, an expansion valve that expands the condensed refrigerant, an evaporator that evaporates the expanded refrigerant and cools a coolant, and a chiller-side control unit that controls an operation so that a coolant outlet temperature, which is the temperature of the coolant cooled at the evaporator, is equal to a desired value, the chiller-side control unit is given a target heat load at which the coolant is output, and when the target heat load is lower than or equal to a predetermined value, the chiller-side control unit outputs a target coolant flow rate, which satisfies the target heat load, of the coolant on the basis of a current coolant inlet temperature, which is a current temperature of the coolant flowing into the evaporator, and a target coolant outlet temperature, which is a coolant outlet temperature to be targeted.

A load (i.e., an output) from the turbo chiller is proportional to a temperature difference between a coolant inlet temperature and a coolant outlet temperature and to a coolant flow rate. Consequently, when the target heat load is lower than or equal to a predetermined value (for example, 20% or lower, and preferably, 10% or lower), there is a limit to reducing the heat load of the turbo chiller so long as the coolant flow rate is a rated flow rate. In the case of an operation in which no particular target coolant outlet temperature is set and a heat load is not to be output, the operation may be performed on the basis of the invention set forth in Japanese Patent Application No. 2007-166843 previously applied by the present inventors, et al. In contrast, problems occur when a target coolant outlet temperature is set and the given target heat load is low.

In the third aspect, the chiller-side control unit is configured to output a target coolant flow rate that satisfies a target heat load on the basis of a current coolant inlet temperature and a target coolant outlet temperature. The coolant is supplied to the turbo chiller on the basis of this target coolant flow rate, thereby achieving a temperature adjustment operation in which the temperature can be controlled to the target coolant outlet temperature even when the target heat load is low.

In a fourth aspect of a method for controlling a heat source system of the present invention in which the heat source system includes a plurality of turbo chillers, a coolant supplying unit that supplies a coolant supplied from these turbo chillers to an external load, and a facility-side control unit that controls a flow rate and the temperature of the coolant, at least one of the plurality of turbo chillers is one of the aforementioned turbo chillers, and the chiller-side control unit in the turbo chiller obtains the target coolant outlet temperature and the target heat load from the facility-side control unit and outputs the target coolant flow rate to the facility-side control unit.

In a typical heat source system, the coolant temperature and the coolant flow rate are controlled at the facility-side control unit that performs centralized control of the entire operation of the heat source system. In addition, the facility-side control unit can ascertain a target heat load that can be tolerated even when the load is low. In the fourth aspect, the target coolant outlet temperature and the target heat load are sent to the chiller-side control unit from the facility-side control unit. The facility-side control unit is capable of obtaining the target coolant flow rate output from the chiller-side control unit of the turbo chiller. Accordingly, a heat source system that allows for a temperature adjustment operation even when the target heat load is low can be provided.

According to the present invention, the chiller-side control unit outputs a target coolant flow rate that satisfies a target heat load on the basis of a current coolant inlet temperature and a target coolant outlet temperature, and a coolant-outlet-temperature adjustment operation of the turbo chiller is performed on the basis of this target coolant flow rate, thereby providing a turbo chiller and a heat source system that allow for temperature adjustment even when the target heat load is particularly low, as well as providing a method for controlling the same.

EXPLANATION OF REFERENCE SIGNS

Figure 1:
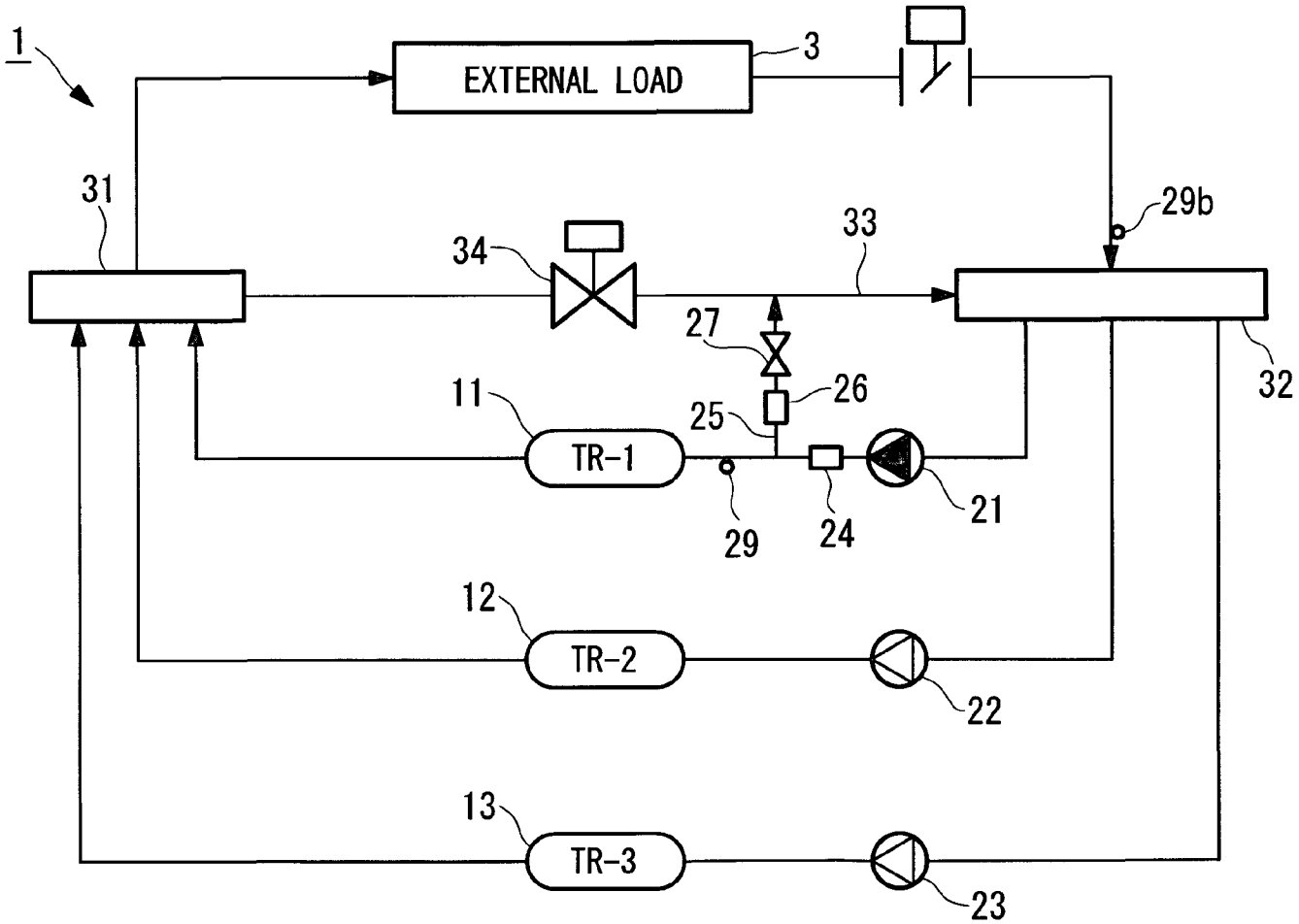
FIG. 1 is a schematic configuration diagram showing a refrigerating system according to an embodiment of the present invention.

1: heat source system
11: first turbo chiller
12: second turbo chiller
13: third turbo chiller
21: first coolant pump
22: second coolant pump
23: third coolant pump
24: first coolant flowmeter
25: first bypass channel
26: first bypass flowmeter
27: first bypass valve
29: first coolant inlet temperature sensor
33: bypass circuit
40: facility-side control unit
42: chiller-side control unit

BEST MODE FOR CARRYING OUT THE INVENTION

An embodiment according to the present invention will be described below with reference to the drawings.

FIG. 1 illustrates the overall configuration of a heat source system according to an embodiment.

A heat source system 1 is installed in a building or in a plant facility. The heat source system 1 is equipped with three turbo chillers, namely, first to third turbo chillers 11, 12, and 13 that apply cold energy to a coolant to be supplied to an external load 3, such as an air conditioner or a fan coil unit. These first to third turbo chillers 11, 12, and 13 are installed in parallel with the external load 3.

Figure 4:
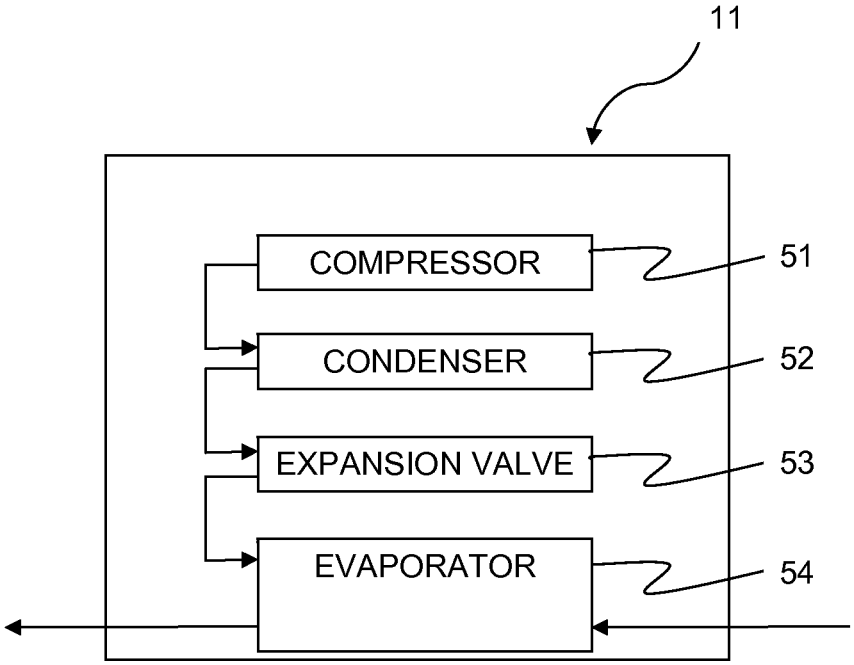
FIG. 4 is a diagram showing a first turbo chiller including a compressor, a condenser, an expansion valve, and an evaporator.

FIG. 4 is a diagram showing a first turbo chiller including a compressor, a condenser, an expansion valve, and an evaporator. The turbo chillers 11, 12, and 13 each include a turbo compressor 51 that compresses a refrigerant, a condenser 52 that condenses the high-temperature high-pressure gas refrigerant compressed by the turbo compressor, an expansion valve 53 that expands the high-temperature high-pressure liquid refrigerant condensed by the condenser, and an evaporator 54 that evaporates the liquid refrigerant expanded by the expansion valve.

The turbo compressor is a centrifugal compressor and is driven under the rotation-speed control of an inverter driving motor. A refrigerant intake port of the turbo compressor is provided with inlet guide vanes (i.e., inlet vanes, referred to as "IGV" hereinafter) that controls the flow rate of refrigerant to be taken in. By adjusting the degree of opening of this IGV, the coolant temperature is adjusted. The degree of opening of the IGV and the rotation speed of the turbo compressor are controlled by a chiller-side control unit.

The evaporator obtains a coolant at a rated temperature (of, for example, 7° C.) by absorbing heat. Specifically, the coolant that flows inside a heat transfer tube extending through the evaporator is cooled as a result of having heat taken away by the refrigerant. The flow rate of this coolant is controlled by coolant pumps 21, 22, and 23 to be described below.

The first to third coolant pumps 21, 22, and 23 for pumping the coolant are disposed on the upstream side of the turbo chillers 11, 12, and 13, respectively, as viewed in the flowing direction of the coolant. These coolant pumps 21, 22, and 23 transfer the coolant from a return header 32 to the respective turbo chillers 11, 12, and 13. Each of the coolant pumps 21, 22, and 23 is driven by an inverter motor whose rotation speed is adjustable so as to allow for adjustable flow-rate control.

Alternatively, a plurality of coolant pumps may be provided for each chiller, such that the adjustable flow-rate control can be performed not only by adjusting the rotation speed, but also by controlling the number of coolant pumps to be used.

The coolant pumps 21, 22, and 23 are controlled by a facility-side control unit that performs centralized control of the entire heat source system 1.

A supply header 31 is configured to collect the coolant obtained at each of the turbo chillers 11, 12, and 13.

The coolant collected by the supply header 31 is supplied to the external load 3.

After undergoing a temperature increase as a result of being supplied for air conditioning, etc. at the external load 3, the coolant is sent to the return header 32. The coolant is divided at the return header 32 and is distributed to the turbo chillers 11, 12, and 13.

A bypass circuit 33 is provided between the supply header 31 and the return header 32. This bypass circuit 33 is provided with an on-off valve 34. By adjusting this on-off valve 34, the flow rate of coolant flowing from the supply header 31 to the return header 32 can be adjusted, thereby adjusting the supply pressure of coolant flowing from the supply header 31 to the external load 3. This on-off valve 34 is controlled by the facility-side control unit.

A first coolant flowmeter 24 for measuring the flow rate from the first coolant pump 21 is provided on the downstream side of the first coolant pump 21. An output from this first coolant flowmeter 24 is sent to the facility-side control unit.

A first bypass channel 25 is provided, which branches off from between the first coolant pump 21 and the first turbo chiller 11 so as to connect to the bypass circuit 33. The first bypass channel 25 is provided with a first bypass flowmeter 26, which measures the coolant flow rate, and a first bypass valve 27. An output from the first bypass flowmeter is sent to a facility-side control unit 40 (see FIG. 2). The degree of opening of the first bypass valve 27 is controlled by the facility-side control unit.

A coolant pipe on the upstream side of the first turbo chiller 11 is provided with a first coolant inlet temperature sensor 29 for measuring the temperature of coolant flowing into the first turbo chiller 11. An output from this first coolant inlet temperature sensor 29 is sent to the facility-side control unit 40.

A coolant pipe on the upstream side of the return header 32 is provided with a temperature sensor **29*b* for detecting the temperature of coolant returning from the external load 3**.

Similar to the first turbo chiller 11, the second turbo chiller 12 and the third turbo chiller 13 are also each provided with a bypass channel, a bypass flowmeter, a bypass valve, and a coolant inlet temperature sensor. However, these components are shown only for the first turbo chiller 11 in FIG. 1 to provide an easier understanding thereof. It is needless to say that it is possible to provide a configuration in which the second turbo chiller 12 or the third turbo chiller 13 are not provided with these components, depending on the intended use.

Figure 2:
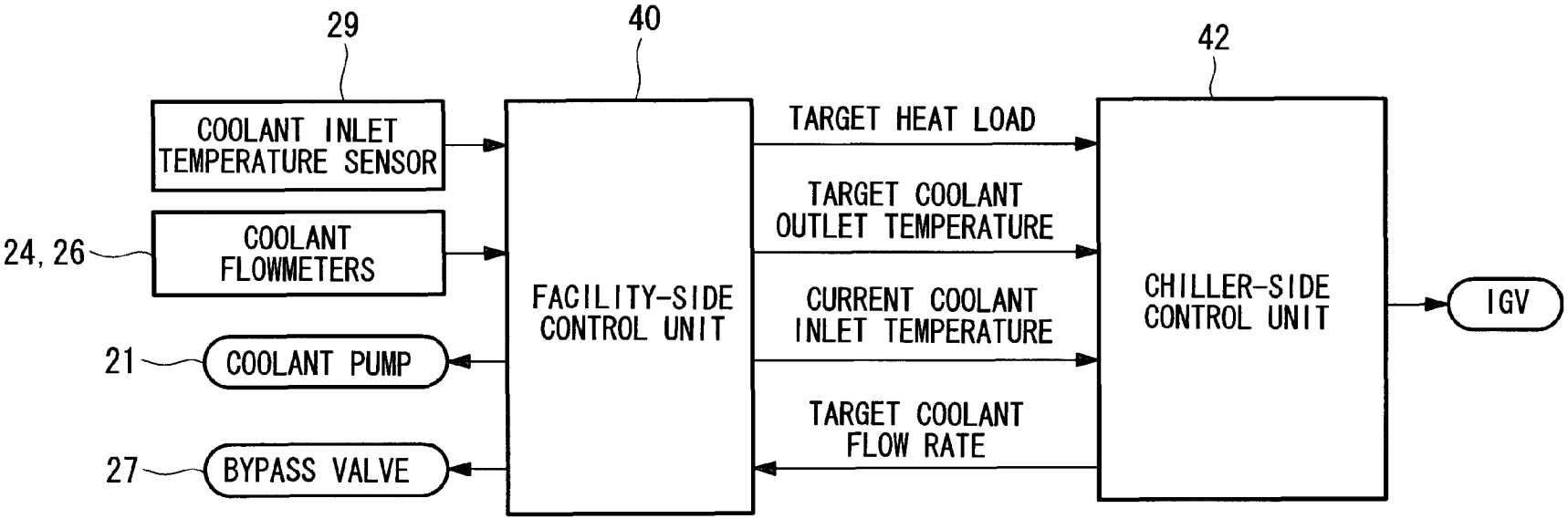
FIG. 2 is a diagram showing the exchange of data between a facility-side control unit and a chiller-side control unit.

FIG. 2 illustrates the exchange of data between the facility-side control unit 40 and a chiller-side control unit 42.

The facility-side control unit 40 sends a target heat load, a target coolant outlet temperature, and a current coolant inlet temperature to the chiller-side control unit 42.

A target heat load refers to a heat load that can be tolerated to an extent that it does not affect the temperature of the coolant merging at the supply header 31. In other words, a target heat load refers to a heat load with which a turbo chiller to be brought online when increasing the number of stages can satisfy a requested coolant outlet temperature (i.e., the target coolant outlet temperature) to an extent that it does not affect the coolant temperature at the supply header 31 where the coolant flows supplied from the other turbo chillers merge.

A target coolant outlet temperature is dependent on the coolant temperature requested by the external load 3 and is set at the facility-side control unit.

A current coolant inlet temperature refers to a coolant inlet temperature in the current state, and is obtained at a predetermined cycle from the first coolant inlet temperature sensor 29 by the facility-side control unit 40.

Based on the target coolant outlet temperature and the current coolant inlet temperature, the chiller-side control unit 42 calculates a target coolant flow rate that satisfies the target heat load and outputs it to the facility-side control unit 40. Specifically, as shown in the following formula, a target coolant flow rate is calculated by using the heat-balance relationship in which a heat load Q output from a chiller is proportional to a temperature difference between a coolant outlet temperature To and a coolant inlet temperature Ti and to a coolant flow rate G.

$$Q=(Ti-To)\times G\times\gamma\times\lambda \quad (1)$$

Here, γ denotes the specific gravity of coolant at an average temperature between those of the coolant inlet and outlet, and λ denotes the specific heat of coolant at the average temperature between those of the coolant inlet and outlet.

The facility-side control unit 40 controls the first coolant pump 21 and the first bypass valve 27 so as to achieve the target coolant flow rate obtained from the chiller-side control unit 42. This control is performed while feeding back output values from the first coolant flowmeter 24 and the first bypass flowmeter 26. In particular, when the flow rate is extremely low, like 3.3% of a rated value, as mentioned above, since the control of the flow rate is difficult with only the rotation-speed control of the coolant pump 21, the degree of opening of the first bypass valve 27 is adjusted in order to obtain a desired flow rate. A flow rate of coolant to be supplied to the first turbo chiller 11 can be obtained from a difference between an output value from the first coolant flowmeter 24 and an output value from the first bypass flowmeter 26.

A method for controlling the heat source system 1 having the above-described configuration will now be described.

The following describes an example where the number of turbo chiller stages is to be increased. Specifically, the following description is based on the assumption that the second turbo chiller 12 and the third turbo chiller 13 are activated, whereas the first turbo chiller 11 is not yet brought online.

A target coolant outlet temperature of, for example, 8° C. is maintained by the second turbo chiller 12 and the third turbo chiller 13. For example, when it is predicted that the humidity of incoming outside air will increase in the near future and that the heat load will thus rapidly increase for dehumidification, such as when rain is approaching and the humidity is expected to increase rapidly, the first turbo chiller 11 enters an early-activation standby mode so that it can output a heat load immediately if there is an activation command instructed by the facility-side control unit 40. An early-activation standby mode is a mode in which a standby operation is performed by supplying a coolant at the target coolant outlet temperature while outputting a heat load that is low enough not to affect the external load. The heat load in this case is an ultra-low heat load of, for example, 20% of a rated value or lower, and preferably, 10% of the rated value or lower.

In the early-activation standby mode, the chiller-side control unit 42 obtains a target coolant outlet temperature, a current coolant inlet temperature, and a target heat load from the facility-side control unit 40. The chiller-side control unit 42 calculates a target coolant flow rate, which satisfies the target heat load, on the basis of the target coolant outlet temperature and the current coolant inlet temperature. Specifically, based on a temperature difference between the target coolant outlet temperature and the current coolant inlet temperature, a percentage thereof with respect to a rated coolant inlet-outlet temperature difference is obtained. This percentage is to become the chiller heat load for the rated coolant flow rate. A ratio of the target coolant flow rate to the rated coolant flow rate is determined so that it is equal to the ratio of the target heat load to this chiller heat load.

For example, the following describes a case where the rated coolant inlet-outlet temperature difference is 5° C., the current coolant inlet temperature is 8° C., the target coolant outlet temperature is 5° C., and the target heat load is 2%. Since the current temperature difference is 8° C.−5° C.=3° C. with respect to the rated temperature difference of 5° C., when the coolant flow rate is the rated value, the turbo chiller operates with an output of 3/5×100%=60%. On the other hand, since the requested target heat load is 2%, the heat output needs to be reduced to 2/60×100%=3.3%, which means that the target coolant flow rate is 3.3% of the rated flow rate.

The target coolant flow rate obtained in this manner is output from the chiller-side control unit 42 to the facility-side control unit 40.

The facility-side control unit 40 performs feedback control on the first coolant pump 21 and the first bypass valve 27 to achieve this target coolant flow rate.

The first turbo chiller 11 is driven in this state so as to prepare for a rapid load increase that may occur in the future.

For example, when a rapid load increase is requested by the facility-side control unit 40 for dehumidification in the event of a rain shower, the first turbo chiller 11 can quickly increase the load since the target coolant outlet temperature is already adjusted.

In the early-activation standby mode, since the coolant flow rate is extremely low (e.g., 3.3% of the rating in the above-described example), and the turbo chiller outputs a refrigeration output according to the target heat load, there is a possibility that the coolant may freeze inside the heat transfer tube of the evaporator. Therefore, it is preferable that the control be performed as follows.

The chiller-side control unit 42 obtains a coolant flow rate in the current state (i.e., current coolant flow rate) from the facility-side control unit 40. If the current coolant flow rate falls below a threshold set on the basis of the target coolant flow rate, it is determined that the coolant may possibly stop inside the heat transfer tube and freeze, thus commencing a stopping operation of the turbo chiller.

Figure 3:
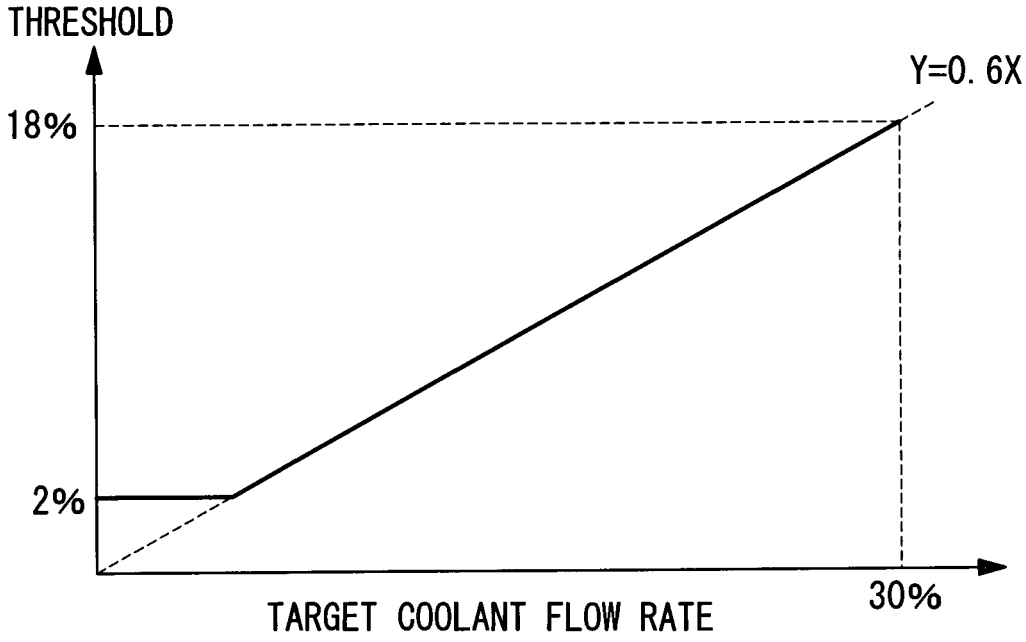
FIG. 3 is a graph showing a threshold of a coolant flow rate to be used when stopping a turbo chiller according to an embodiment of the present invention.

In detail, the threshold is set as shown in FIG. 3. In the figure, the abscissa indicates the target coolant flow rate expressed as a percentage with respect to the rated coolant flow rate. The ordinate indicates the threshold of the coolant flow rate for commencing the stopping operation of the turbo chiller.

As shown in the figure, when the target coolant flow rate is lower than or equal to 30% of the rated value, the threshold is 60% of the target coolant flow rate. Thus, when the flow rate is 30% of the rated value, 60% thereof, which is 18%, is the threshold. Since the threshold can be changed according to the target coolant flow rate in this manner, an appropriate threshold can be set according to the operating conditions.

However, the threshold is prevented from falling below 2% even if the target coolant flow rate is to decrease further. Providing an absolute lower limit for the threshold in this manner allows for protection of the device.

Alternatively, the chiller-side control unit 42 may obtain an evaporation pressure inside the evaporator, and the stopping operation of the turbo chiller may be commenced when this evaporation pressure is lower than or equal to a predetermined value. Accordingly, since the evaporation pressure being lower than or equal to the predetermined value implies that the evaporation temperature is decreased to a predetermined value or lower, it is possible to properly predict that the coolant may freeze inside the heat transfer tube. This control based on the evaporation pressure is preferably used in combination with the above-described control based on the coolant flow rate. In detail, the stopping operation of the turbo chiller is performed when either the coolant flow rate or the evaporation pressure falls below a predetermined value. By using the coolant flow rate and the evaporation pressure in this manner, the stopping operation can still be properly performed even in the event of failure of one of the sensors. Furthermore, although an output from a flowmeter is generally obtained by the chiller-side control unit 42 via the facility-side control unit 40, the use of the evaporation pressure is advantageous in that the process can be completed by the chiller-side control unit 42 without the intervention of the facility-side control unit 40. When in an environment where the coolant flow rate cannot be obtained from the facility-side control unit 40, the control for the stopping operation can be performed based only on the evaporation pressure.

Furthermore, as a backup in the event of failure, etc. of the sensors, a liquid refrigerant temperature of the evaporator or a current coolant outlet temperature may be used.

In the early-activation standby mode, since the coolant flow rate is extremely low, as described above, temperature adjustment control of the turbo chiller is preferably performed in the following manner.

The temperature of the coolant is controlled by changing the degree of opening of the IGV. This degree of opening of the IGV is obtained by performing feedback control (e.g., PID control or PI control) using a current coolant outlet temperature. The sensitivity to the control output during this feedback control is reduced according to a decrease in the current coolant flow rate.

In a normal rated operation, the control gain used when obtaining the degree of opening of the IGV is a control gain set based on when the coolant flow rate is equal to the rated value. However, because the coolant flow rate is significantly lower than the rated value during the early-activation standby mode, the use of a control gain for the rated value causes the sensitivity to be excessively high, thus possibly resulting in overshooting. Such being the case, the sensitivity to the feedback-control output when obtaining the degree of opening of the IGV is reduced according to a decrease in the current coolant flow rate so as to ensure controllability. For example, a proportional gain is set in inverse proportion to the coolant flow rate. Alternatively, an integral time of an integral gain may be set in inverse proportion to the coolant flow rate.

Although this embodiment describes the operation performed when increasing the number of turbo chiller stages, the present invention can also be applied to when reducing the number of turbo chiller stages. Specifically, when a heat load requested by the external load 3 decreases and the number of turbo chiller stages is to be reduced by one, this turbo chiller may continue to operate in the above-described early-activation standby mode without being completely stopped. This allows this turbo chiller to respond immediately when the load increases again.

The number of turbo chiller stages is not limited to three as in this embodiment; it may alternatively be two or four or more.

Furthermore, the number of turbo chillers operable in the above-described early-activation standby mode may be only one, some of the turbo chillers, or even all of the turbo chillers.

The invention claimed is:

1. A refrigeration system comprising:

a plurality of turbo refrigerators cooling a coolant, the plurality of turbo refrigerators including at least a first turbo refrigerator and a second turbo refrigerator;

a facility-side control unit that controls a flow rate and the temperature of the coolant; and a coolant supplying unit connected to each of the plurality of turbo refrigerators to receive the coolant from each of the turbo refrigerators to merge the respective received coolant and supply thus merged coolant to an external load, the plurality of turbo refrigerators being connected to the coolant supplying unit in parallel;

each of the turbo refrigerators having a rated coolant flow rate and comprising a turbo compressor that compresses a refrigerant, a condenser that condenses the compressed refrigerant, an expansion valve that expands the condensed refrigerant, an evaporator that evaporates the expanded refrigerant and cools a coolant, and a refrigerator-side control unit that controls an operation so that a coolant outlet temperature, which is the temperature of the coolant cooled at the evaporator, is equal to a desired value;

wherein a first turbo refrigerator of the plurality of turbo refrigerators is rendered in an early-activation standby mode in which the refrigerator-side control unit receives a target heat load at which the turbo refrigerator operates, wherein a heat load of the turbo refrigerator is a function of a flow rate of the coolant flowing into the evaporator;

wherein the refrigerator-side control unit of the first turbo refrigerator receives a current coolant inlet temperature and a target coolant outlet temperature, wherein the current coolant inlet temperature is a current temperature of the coolant flowing into the evaporator of the first turbo refrigerator, and wherein the target coolant outlet temperature is a target temperature of the coolant at the outlet of the evaporator, wherein the refrigerator-side control unit of the first turbo refrigerator determines whether the target heat load is lower than or equal to a predetermined threshold value, and if so, the refrigerator-side control unit calculates a target coolant flow rate of the coolant flowing into the evaporator of the first turbo refrigerator so as to lower the flow rate of the coolant flowing into the evaporator to an amount below the rated coolant flow rate of the first turbo refrigerator, on the basis of the current coolant inlet temperature and the target coolant outlet temperature, such that the target coolant flow rate satisfies the target heat load, while the second turbo refrigerator maintains the rated coolant flow rate, wherein the refrigerator-side control unit in the first turbo refrigerator obtains the target coolant outlet temperature and the target heat load from the facility-side control unit and outputs the target coolant flow rate to the facility-side control unit.

2. The refrigeration system according to claim 1, wherein the refrigerator-side control unit of the first turbo refrigerator obtains a current coolant flow rate, which is a coolant flow rate in a current state, and performs an operation for stopping the operation of the first turbo refrigerator when the current coolant flow rate is lower than or equal to a predetermined value that falls below the target coolant flow rate of the first turbo refrigerator.

3. The refrigeration system according to claim 1, wherein the refrigerator-side control unit of the first turbo refrigerator obtains an evaporation pressure inside the evaporator of the first turbo refrigerator and performs an operation for stopping the operation of the first turbo refrigerator when the evaporation pressure is lower than or equal to a predetermined value.

4. The refrigeration system according to claim 1, further comprising a temperature adjusting unit which controls the temperature of the coolant, and a feedback-control output which the temperature adjusting unit responds to, wherein the sensitivity of the temperature adjusting unit to the feedback-control output is reduced according to a decrease in a current coolant flow rate.

5. A method for controlling a refrigeration system that comprises a plurality of turbo refrigerators cooling a coolant, the plurality of turbo refrigerators including at least a first turbo refrigerator and a second turbo refrigerator;

a facility-side control unit that controls a flow rate and the temperature of the coolant; and a coolant supplying unit connected to each of the plurality of turbo refrigerators to receive the coolant from each of the turbo refrigerators to merge the respective received coolant and supply thus merged coolant to an external load, the plurality of turbo refrigerators being connected to the coolant supplying unit in parallel; each of the turbo refrigerators having a rated coolant flow rate and includes a turbo compressor that compresses a refrigerant, a condenser that condenses the compressed refrigerant, an expansion valve that expands the condensed refrigerant, an evaporator that evaporates the expanded refrigerant and cools a coolant, and a refrigerator-side control unit that controls an operation so that a coolant outlet temperature, which is the temperature of the coolant cooled at the evaporator, is equal to a desired value; the method comprising:

rendering a first turbo refrigerator of the plurality of turbo refrigerators in an early-activation standby mode, receiving, by the refrigerator-side control unit of the first turbo refrigerator, a target heat load at which the turbo refrigerator operates, wherein a heat load of the turbo refrigerator is a function of a flow rate of the coolant flowing into the evaporator;

receiving, by the refrigerator-side control unit of the first turbo refrigerator, a current coolant inlet temperature and a target coolant outlet temperature, wherein the current coolant inlet temperature is a current temperature of the coolant flowing into the evaporator of the first turbo refrigerator, and wherein the target coolant outlet temperature is a target temperature of the coolant at the outlet of the evaporator, determining, by the refrigerator-side control unit of the first turbo refrigerator, whether the target heat load is lower than or equal to a predetermined threshold value, and if so, calculating a target coolant flow rate of the coolant flowing into the evaporator of the first turbo refrigerator so as to lower the flow rate of the coolant flowing into the evaporator to an amount below the rated coolant flow rate of the first turbo refrigerator, on the basis of the current coolant inlet temperature and the target coolant outlet temperature, such that the target coolant flow rate satisfies the target heat load, and maintains the rated coolant flow rate for the second turbo refrigerator, wherein the refrigerator-side control unit in the first turbo refrigerator obtains the target coolant outlet temperature and the target heat load from the facility-side control unit and outputs the target coolant flow rate to the facility-side control unit.

* * * * *